US005178382A

United States Patent [19]

Chung et al.

[11] Patent Number: 5,178,382

[45] Date of Patent: Jan. 12, 1993

[54] TRAY TRANSFERRING APPARATUS OF SORTER FOR COPY MACHINE

[75] Inventors: Jae H. Chung, Uijongbu; Yeon K. Jung, Bucheonsi, both of Rep. of Korea

[73] Assignee: Sindo Ricoh Co., Ltd., Seoul, Rep. of Korea

[21] Appl. No.: 714,455

[22] Filed: Jun. 13, 1991

[30] Foreign Application Priority Data

Mar. 12, 1991 [KR] Rep. of Korea ..... 1991-4036

[51] Int. Cl.[5] ..... B65H 39/10

[52] U.S. Cl. ..... 271/293; 271/294

[58] Field of Search ..... 271/287, 288, 292, 293, 271/294

[56] References Cited

FOREIGN PATENT DOCUMENTS 0212556 12/1983 Japan ..... 271/293

0034865 2/1989 Japan ..... 271/287

*Primary Examiner*—H. Grant Skaggs

*Assistant Examiner*—Carol Lynn Druzbick

*Attorney, Agent, or Firm*—Darby & Darby

[57] ABSTRACT

A tray transferring device of sorter for copy machine comprising first and second slot liners each having an inclined middle portion, third and fourth slot liners formed on said opposite side plates of the sorter, first and second transfer wheels mounted at respective inclined middle portions of said first and second slot liners, power transferring means connected between said first and second transfer wheels, rack movement controlling means mounted at said opposite side plates, rack driving means each connected to said rack movement controlling means, a pair of racks each engaging with said rack driving means, a base pin extending between respective lowest portions of said first and second slot liners, tray supporting means fixedly connected to said opposite side plates. The present invention can provide a tray transferring device which can prevent the instantaneous increase of the load from a tray transferring device during the successive transferring of the bin trays so that the total load to be loaded to the tray transferring device may be reduced, thereby causing the bin tray to be smoothly transferred, and reduce the noise which may be generated from the intermittent and instantaneous movement of the bin tray, and also increase the transferring speed of the bin tray.

8 Claims, 6 Drawing Sheets

TRAY TRANSFERRING APPARATUS OF SORTER FOR COPY MACHINE

BACKGROUND OF THE INVENTION

1. Field of The Invention

The present invention relates to a tray transferring apparatus of a sorter equipped with slot liners and transfer wheels adapted for transferring bin trays each having a pair of pin trays, and more particularly to a tray transferring apparatus of a sorter which supports and transfers the whole bin tray by a rack moving in the vertical direction by using the driving power of the transfer wheel.

2. Description of The Prior Art

Generally, a known sorter of copy machine, which is equipped with slot liners and transfer wheels, has adopted a method of arranging and separating the copy sheets by transferring successively a plurality of bin trays.

An example of the conventional tray transferring apparatus, as disclosed in U.S. Pat. Nos. 4,328,963 and 4,332,377, was provided with a wire of which one side was connected to the pin of the bin tray located at the lowest part of the sorter and the other side is connected to the spring positioned at the upper portion of the sorter. In the practical products of the sorter having the transferring apparatus disclosed in the above U.S. patents, The bin tray transferring apparatus adopted a spring instead of the wire was directly connected to the pin of the bin tray located at the lowest part of the sorter. However, such type of sorters should use the spring which had relatively large restoring power so that, when a pin was transferred downward, an instantaneous overload loaded at the transfer wheel might cause a loud noise.

There has been also proposed a known sorter using a drum cam instead of the transfer wheel. For examples, a sorter disclosed in U.S. Pat. No. 4,466,609 used two drum cams and a support frame, and a sorter disclosed in United Kingdom Patent No. 2,168,037 was equipped with auxiliary bin tray supporter separately provided and having the same shape as that of the slot liner so that the bin tray could move vertically upward and downward upon providing a simultaneous moving of the inner portion of the bin tray, pin side, and the outer portion of that, tap side. But, it has been noted that such type of bin tray transferring apparatus using the support frame had difficulty in applying to the sorter using the transfer wheel.

Also, as disclosed in Japanese Patent laid-open publication No. sho 60-232370, a transferring apparatus capable of using support frame in the construction of using the transfer wheel has been proposed. However, such type of transferring apparatus should have an auxiliary protrusion provided at a part of the outside of the radius of gyration of the transfer wheel and more equipments such as cams and outer springs adapted to drive the transfer wheel. Furthermore, this type of transferring apparatus should have a contact surface provided at the bin tray and adapted for contacting with the pin during driving the transferring apparatus, and the transfer wheel should move in revolution and precipitation at the same time.

Korean Patent Laid-Open Publication No. 91-371 disclosed a transferring apparatus of sorter adopting a method capable of reducing the noises by changing the shape of transfer wheel to have a camming mechanism.

Also, as disclosed in Korean Patent Application Nos. 90-855 and 90-16620, which were applied by this applicant, there has been proposed another type of sorter having a slot liner having an inclined middle portion extending from the upper and lower vertical portions of the slot liner toward the ejecting section of the copy machine. This type of sorter could provide an advantage that the bin tray could advance closer to the ejecting section of the copy machine, thereby making it possible to receive and arrange the copies without any auxiliary guiding unit. However, it has been noted that there were a disadvantage that the sorter of this type was provided with a conventional transfer wheel, that is to say, the circular transfer wheel having first and second slots arranged along the diameter of said transfer wheel and extending radially inward from the circumference of said transfer wheel, thereby spending a long time for separating and arranging the copies so that it could separate and arrange the copies only two times during one rotation of the transfer wheel. Also, there was another disadvantage that the sorter adopted the method of urging usually the bin trays upwards by upwardly biasing the base pin of the bin tray by means of the spring mounted at the upper portion of the side plate of the sorter so that the upward and downward movements of the pin of the bin tray could not be smoothly carried out during the rotation of the transfer wheel, and a loud noise might be generated.

In an effort for solving the above-mentioned disadvantages, the applicant of this invention has proposed a sorter having a transfer wheel provided with three slots, as disclosed in Korean Patent Application No. 90-18264, instead of the above-mentioned transfer wheel provided with two slots. The sorter of this type could carry out one transferring operation for the bin tray during one third cycle of rotation of the transfer wheel as a result of the three slots each arranged at every 120° on the transfer wheel and extending radially inward from a circumference of said transfer wheel, and also transfer slowly and upwardly another lower waiting bin tray according to the driving rate of the transfer wheel because the transfer wheel was also provided with involute portions each formed at sections which might contact with the pin of the bin so that a waiting pin tray could be smoothly and naturally located within the radius of gyration of said transfer wheel. Thus, this type of transfer wheel could be applied to various types of sorters provided with biasing units for urging the bin tray upwardly, said biasing units using a spring, a wire, a rack or a supporting mechanism.

However, the above-mentioned type of sorter had the transfer wheel comprising an integrally formed rotator and the three slots formed on the rotator. Therefore, there has been a disadvantage of enlarging the noise because of adding a noise generated while a bin tray seated on the upper portion of the transfer wheel was instantaneously received in a slot of said transfer wheel to the noise generated by the instantaneous overload during driving said transfer wheel in order to pick up downwardly and push upwardly the pin of the bin tray.

SUMMARY OF THE INVENTION

It is an object of the present invention to provide a sorter provided with a bin tray transferring device capable of transferring successively respective bin trays by using the rotation power of the transfer wheel and transferring the whole bin trays upwardly and downwardly by driving a rack to move upwardly and downwardly.

It is another object of the present invention to provide a sorter provided with a tray transferring device capable of maintaining the same inclination angle of the bin tray and space between the bin trays during transferring upwardly and downwardly said bin trays.

In one aspect, the present invention provides, in a sorter for copy machine provided with a tray transferring device for transferring bin trays each having a pair of pins at both ends thereof, said tray transferring device comprising: first and second slot liners formed on opposite side plates of the sorter, respectively, and each having an inclined middle portion extending toward an ejecting section of the copy machine, a first transfer wheel mounted at said inclined middle portion of said first slot liner and including a normally formed rounded portion having a height difference between a start point and a last point of a guide passage adapted for contacting with one pin of said pins in order to guide said pin, said height difference being larger than a diameter of said pin, a second transfer wheel mounted at the inclined middle portion of said second slot liner and including a normally formed rounded portion having a height difference between a start point and a last point of a guide passage adapted for contacting with the other pin of said pins in order to guide said pin, said height difference being larger than a diameter of said pin, power transferring means connected between said first and second transfer wheels and adapted for providing the same rotation rate therefor, rack movement controlling means mounted at said opposite side plates and adapted for controlling a driving rate of racks by using a rotation power of said first and second transfer wheels, rack driving means each connected to said rack movement controlling means, a pair of racks each engaging with said rack driving means and having a lower portion fixedly connected to said pin tray of a lowest positioned bin tray, and supporting means fixedly connected to said opposite side plates and adapted for supporting said whole bin trays.

In other aspect, the present invention provides, in a sorter for copy machine provided with a tray transferring device for transferring bin trays each having a pair of pins at both ends thereof, said tray transferring device comprising: first and second slot liners formed on opposite side plates of the sorter, respectively, and each having an inclined middle portion extending toward an ejecting section of the copy machine, third and fourth slot liners downwardly formed on said opposite side plates of the sorter, respectively, and each adapted for guiding the movement of tray supporter supporting means, a first transfer wheel mounted at the inclined middle portion of said first slot liner and including a normally formed rounded portion having a height difference between a start point and a last point of a guide passage adapted for contacting with one pin of said pins in order to guide said pins, said height difference being larger than a diameter of said pin, a second transfer wheel mounted at the inclined middle portion of said second slot liner and including a normally formed rounded portion having a height difference between a start point and a last point of a guide passage adapted for contacting with the other pin of said pins in order to guide said pin, said height difference being larger than a diameter of said pin, power transferring means connected between said first and second transfer wheels and adapted for providing the same rotation rate therefor, rack movement controlling means mounted at said opposite side plates and adapted for controlling a driving rate of racks by using a rotation power of said first and second transfer wheels, rack driving means each connected to said rack movement controlling means, a base pin extending between respective lowest portions of said first and second slot liners, a pair of racks each engaging with said rack driving means and having a lower portion fixedly connected to each end of said base pin and tray supporting means fixedly connected to said opposite side plates, respectively, and forming a supporter movable upward and downward along said third and fourth slot liners in order to provide the same upward and downward movements for inner and outer portions of said bin trays at the same time during movement of the whole bin trays.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
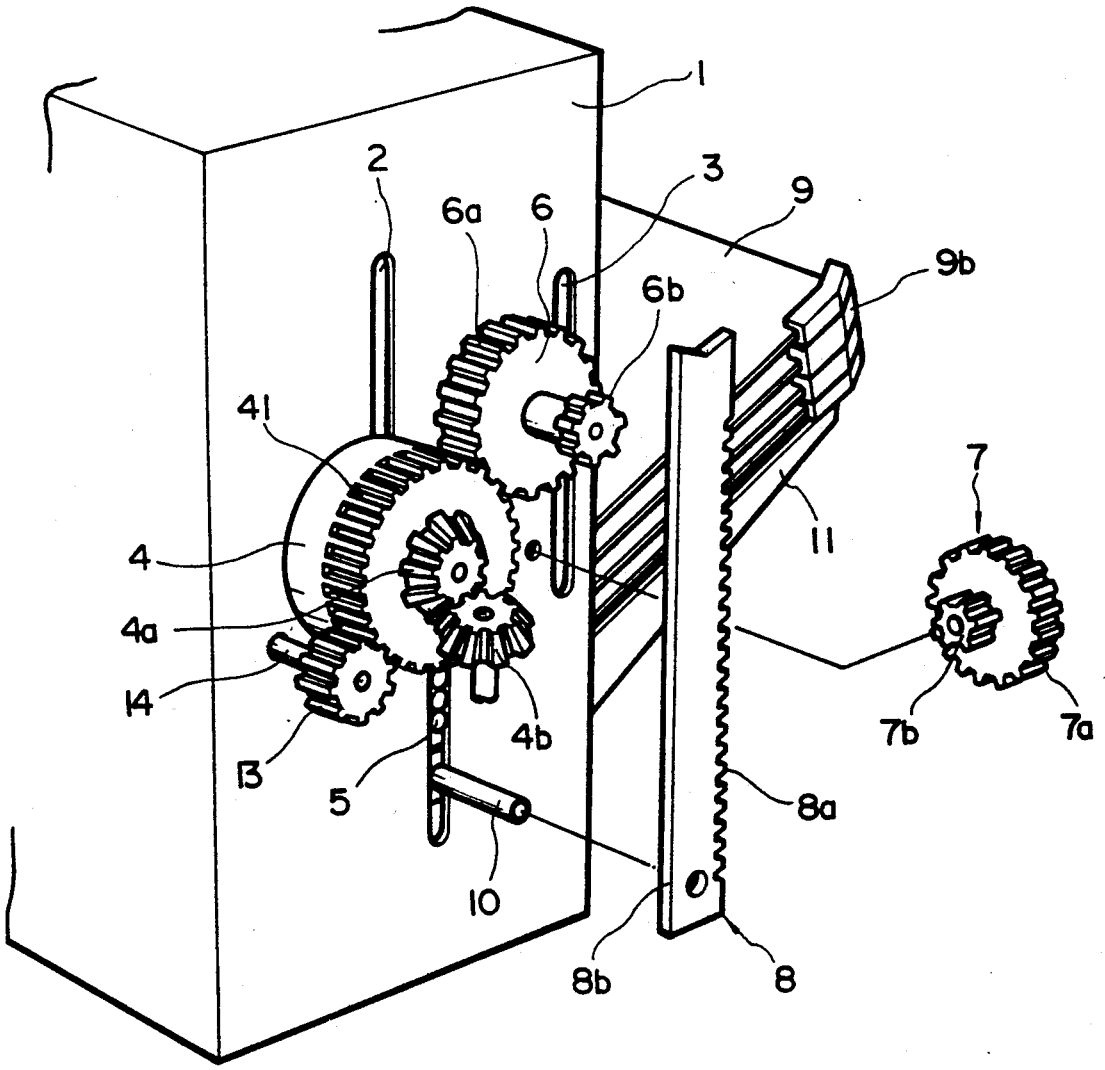
FIG. 1 is a broken schematic perspective view showing an embodiment of a tray transferring device in accordance with the present invention.
Figure 2A:
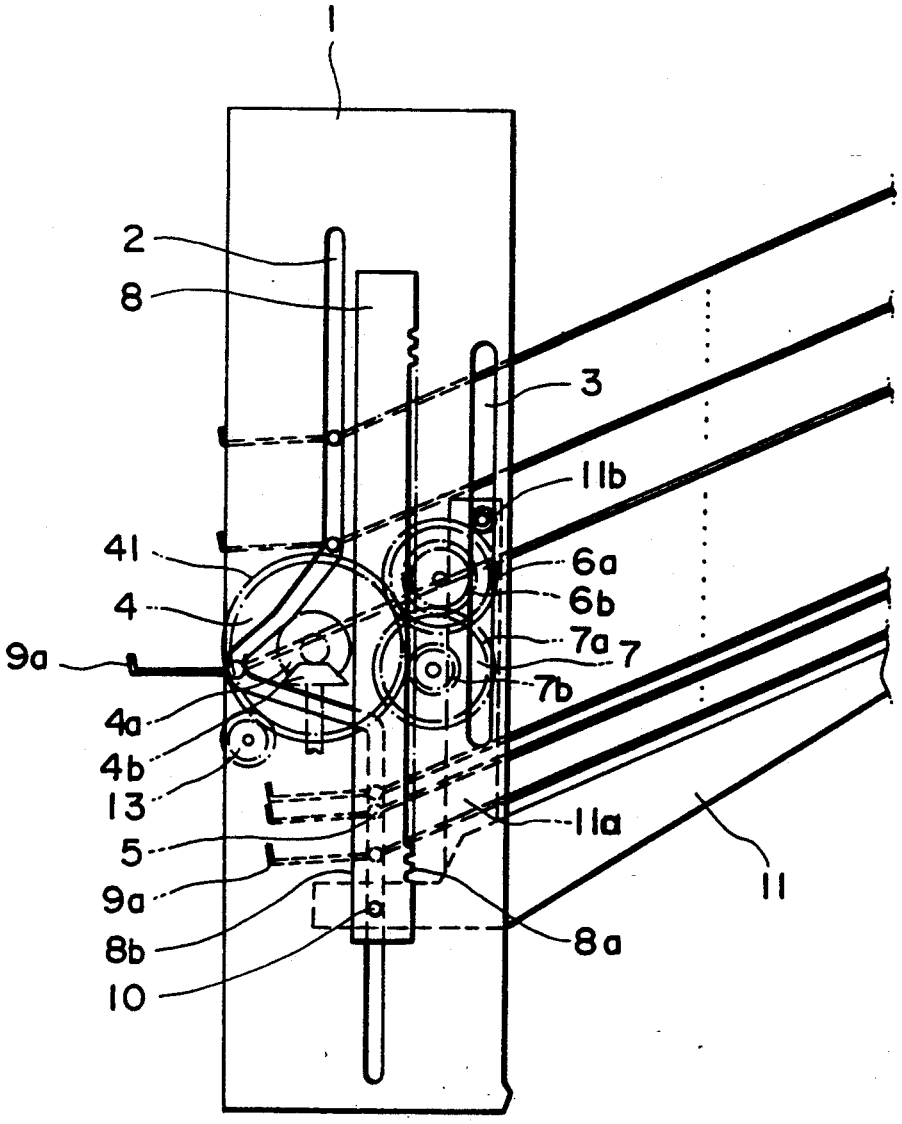
FIGS. 2A and 2B are schematic right and left side views showing the tray transferring device of FIG. 1, respectively.
Figure 2B:
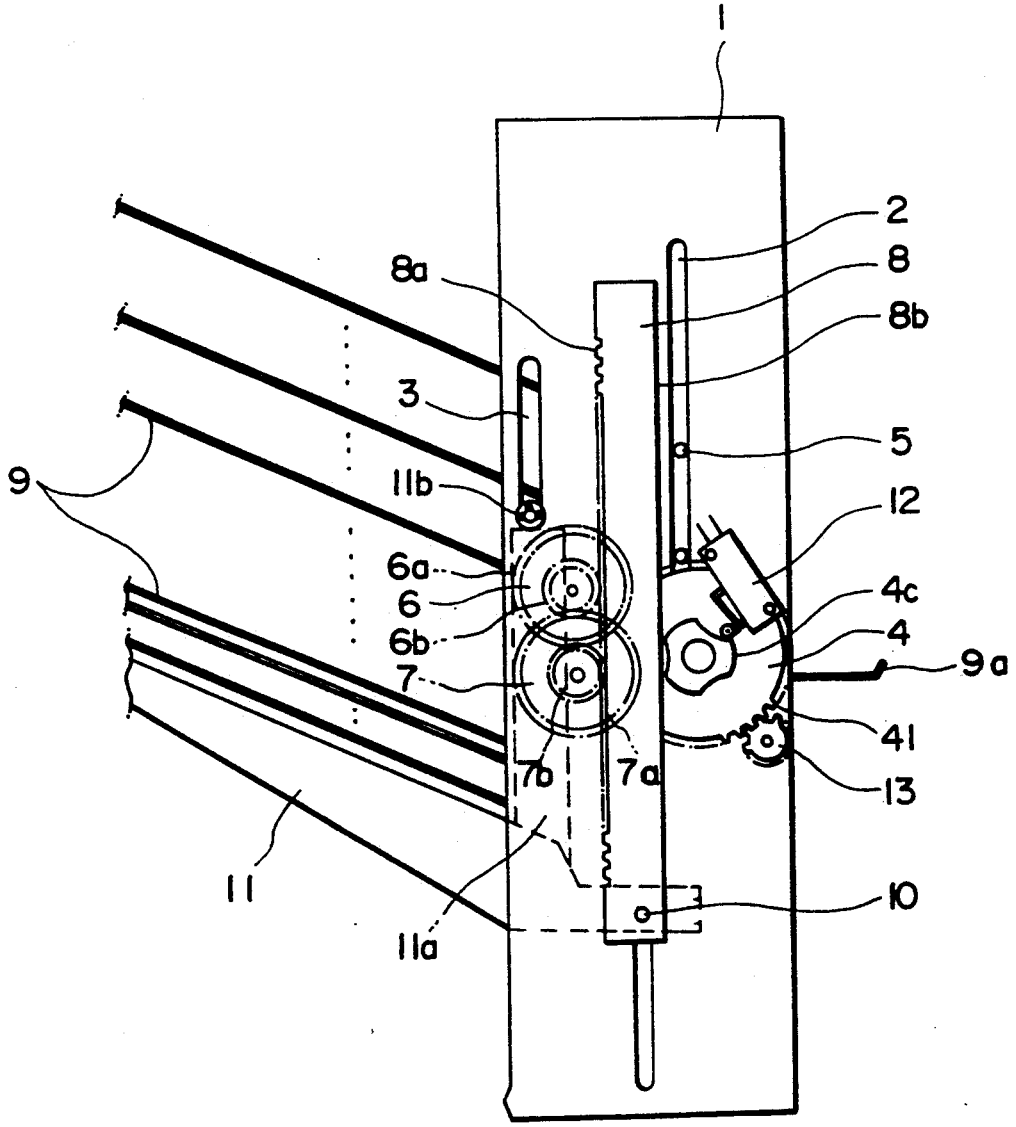
Figure 3:
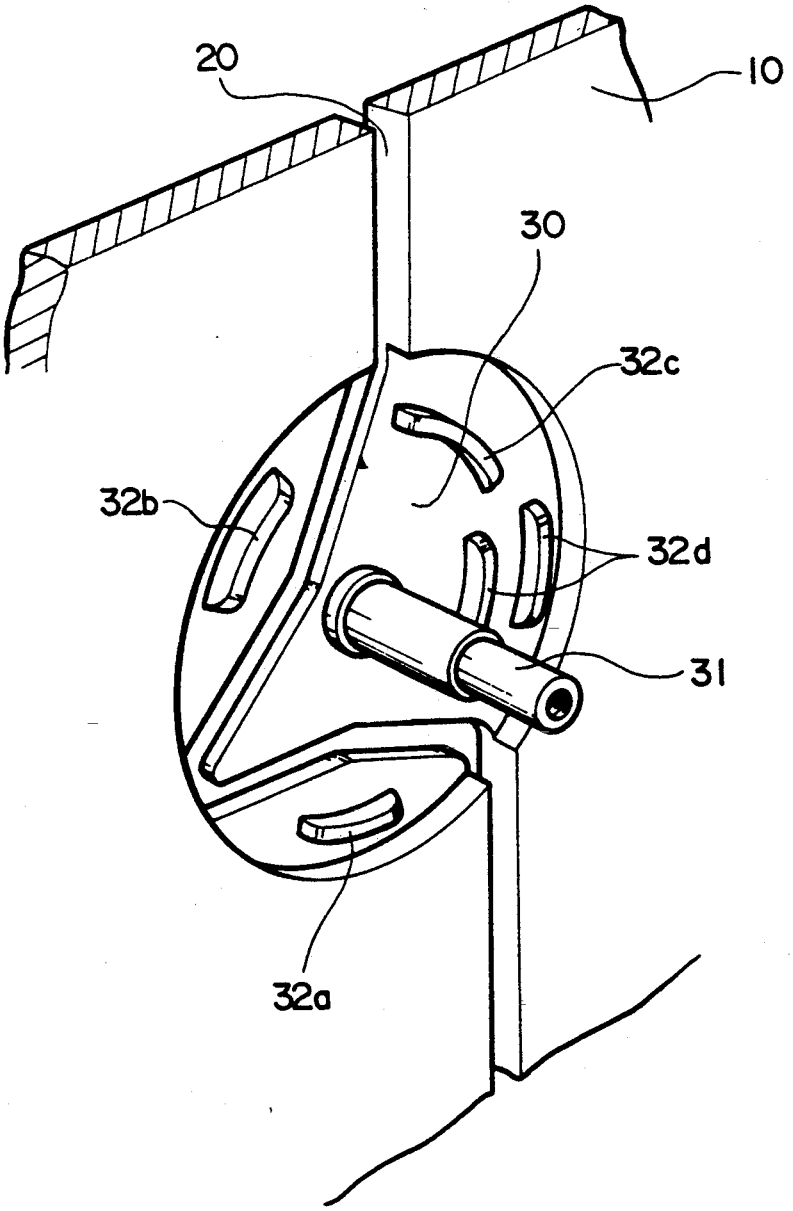
FIG. 3 is a perspective view of a side plate provided with a transfer wheel in accordance with the present invention.
Figure 4:
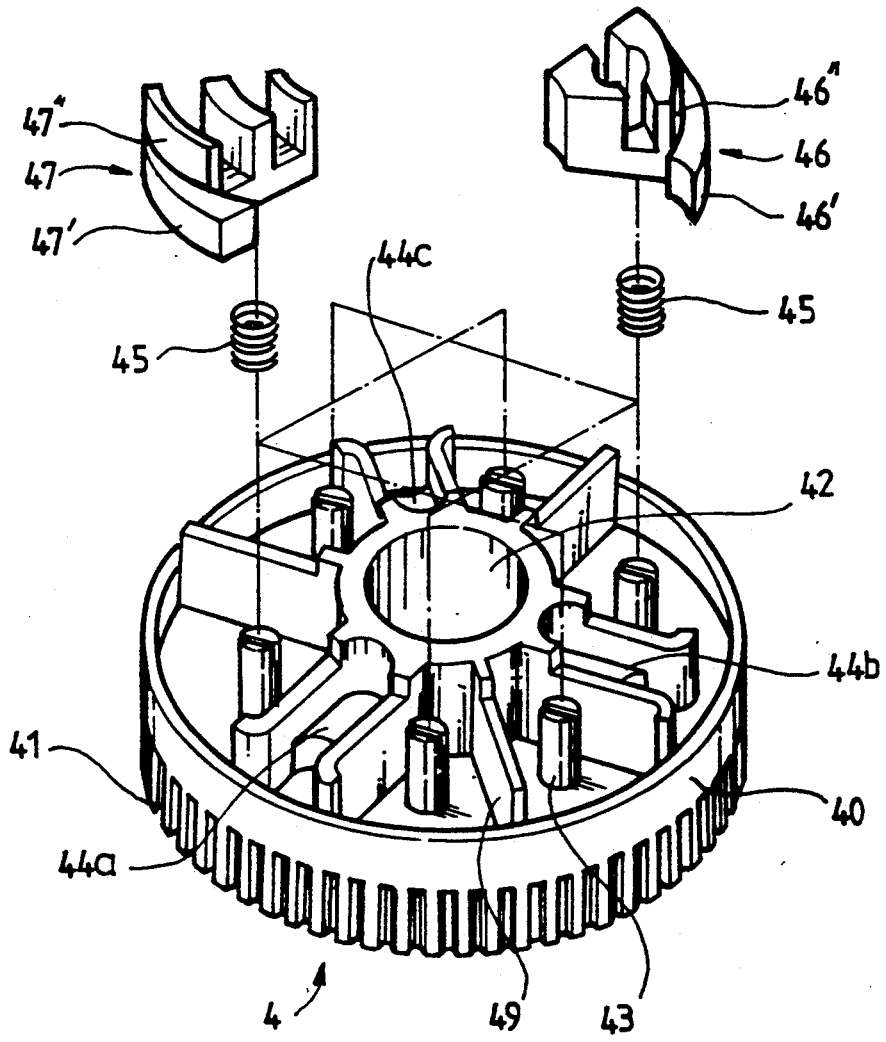
FIG. 4 is a broken perspective view of an embodiment of a transfer wheel in accordance with the present invention.

Referring to FIGS. 1 to 5, FIG. 1 of a broken schematic perspective view showing an embodiment of a tray transferring device in accordance with the present invention, FIGS. 2 of schematic right and left side views showing the tray transferring device of FIG. 1, respectively, FIG. 3 of a perspective view of a side plate provided with a transfer wheel in accordance with the present invention, FIG. 4 of a broken perspective view of an embodiment of a transfer wheel in accordance with the present invention, and FIGS. 5 of side views of two embodiments of transfer wheel in accordance with the present invention, respectively, the tray transferring device according to this invention is provided with a pair of transfer wheels 4 each mounted at the side plate 1 of sorter so that an inclined middle portion of slot liner 2 may be within the radius of gyration thereof. The side plate 1 of the sorter has a surface contacting with the transfer wheel 4, said contacting surface provided with a plurality of projections 32*a* to 32*d* each having a normal shape and adapted for driving the insert wheels of the transfer wheel, as shown in FIG. 3.

Figure 5A:
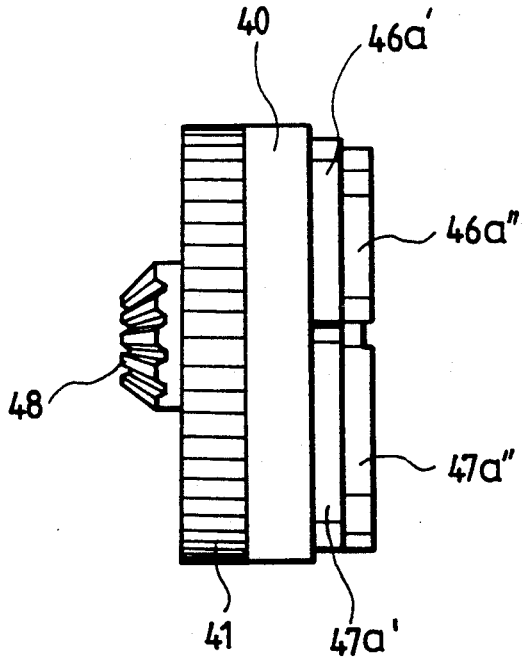
FIGS. 5A and 5B are side views of two embodiments of transfer wheel in accordance with the present invention, respectively.
Figure 5B:
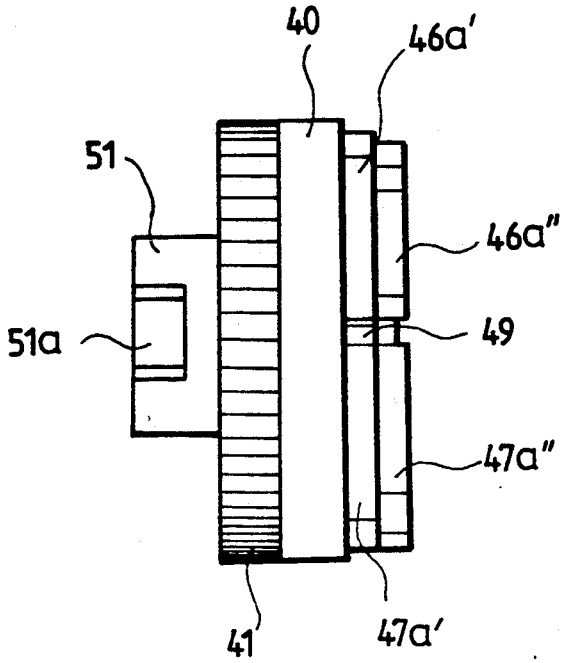

As shown in FIGS. 2, the tray transferring device has two types of transfer wheels respectively having outer shapes different from each other, a first transfer wheel mounted at a motor driving side and having a shape shown in FIGS. 4 and 5A, a second transfer wheel mounted at a rotation detecting side and having other shape shown in FIGS. 4 and 5B. The first transfer wheel 4 at the motor driving side is provided with a bevel geared shaft 4*a* mounted on the rear surface thereof and adapted for transferring the power from a motor (not shown) to said first transfer wheel 4, a spur gear 41 formed on the whole circumferential surface thereof and adapted for transferring the rotation power of the transfer wheel to another driven means, said spur gear 41 engaging with a middle gear 6 controlling the upward and downward moving distances of a rack 8 according to a diameter of the pin, and a shaft driving gear 13 adapted for driving the second transfer wheel 4. The middle gear 6 controlling the upward and downward moving distances of the rack 8 according to the rotation of the first transfer wheel 4 comprises an idle gear 6*a* and a middle reduction gear 6*b*. The middle reduction gear 6*b* is integrally formed with the idle gear 6*a* at the center of the idle gear 6*a* and engages with a rack driving gear 7 which comprises a rack driving reduction gear 7*a* engaging with said middle reduction gear 6*b* and a pinion gear 7*b* engaging with a rack gear 8. Here, the rack 8 has a linear rear portion 8*b* supported by the circumferencial side surface of the bevel geared shaft 4*a* of the first transfer wheel 4.

Now, a structure of the other side having the second transfer wheel 4 will be described in conjunction with FIG. 2B.

As shown in FIG. 2B, the structure of the other side of the tray transferring device has the same structure as that of the one side having the first transfer wheel 4 shown in FIG. 2A and having been hitherto described except the outer shape (see FIG. 5B) of the second transfer wheel 4 and additionally comprising the rotation detecting microswitch 12. The second transfer wheel 4 will be driven by means of the shaft driving gears 13 engaging with the respective spur gears 41 of the first and second transfer wheels 4, respectively, and transferring the rotation power from the first transfer wheel 4 to the second transfer wheel 4 upon receiving the rotation power from the first transfer wheel 4 so that both pins of the bin tray can be transferred along the slot liners 2 at the same time.

Referring again to FIGS. 2A and 2B, the pins of the lowest bin tray are inserted into the lower portions of the opposite racks 8, respectively, in order to cause the whole bin trays to move upward or downward along the slot liners 2 according to upward or downward movement of the racks 8. There are provided a pair of fixed tray supporters each fixedly mounted at the lower portion of the side plate 1 and adapted for supporting the whole bin trays.

In addition, the tray transferring device according to this invention is provided with a movable tray supporter 11, as shown in FIGS. 2, positioned under the lowest bin tray and adapted for supporting the whole bin trays upwardly, thereby providing the maintenance of an inclination angle and a space for the bin trays during transferring upwardly and downwardly said bin trays. The movable tray supporter 11 has a base pin 10 seated on the lowest portions of the respective slot liners 2 by means of both ends thereof. Also, the movable tray supporter 11 is provided with a supporting pin 11*b*, thereby causing the movable tray supporter 11 to be supported by both ends of the base pin 10 and the supporting pin 11*b* and also causing the both sides of the movable tray supporter 11 to move upward or downward at the same time.

In the first embodiment of the tray transferring device according to this invention of FIG. 1, the device is provided a pair of bevel gears 4*a* and 4*b*, adapted for transferring the rotation power from the driving motor (not shown) to the first transfer wheel 4 at the motor driving side, a first bevel gear 4*a* fixedly mounted at the rear surface of the first transfer wheel 4 and a second bevel gear 4*b* engaging with the first bevel gear 4*a* and connected to the driving motor, said second bevel gear 4*b* vertically transferring the rotation power from the motor to the first bevel gear 4*a* in order to driving the first transfer wheel 4. The rack 8 will, therefore, move slowly and upwardly upon clockwise rotation of the first transfer wheel 4 in order to transfer the bin trays upwardly, but move slowly and downwardly upon counter-clockwise rotation of the first transfer wheel 4 in order to transfer the bin trays downwardly. In the same manner, the other rack 8 at the rotation detecting side can simultaneously transfer the bin trays by the clockwise and counter-clockwise rotations of the second transfer wheel 4 transferred the rotation power from the first transfer wheel 4 by way of the shaft driving gears 13 and a driving shaft 14 extending between said two shaft driving gears 13.

Therefore, the tray transferring device according to this invention can provide a successive and linear movement instead of the intermittent and instantaneous movement for the pin tray. Said successive and linear movement can be provided by the structure comprising the rack 8 and the pinion 7*b* respectively provided in order to slowly and upwardly transfer the base pin 10 connected to the rack 8. Thus, this tray transferring device can smoothly transfer the bin trays because, using a gear ratio of the pinion 7*b* connected to the transfer wheel 4, the racks 8 can transfer the base pin 10 upwardly in order to allow each bin tray to move upwardly to a waiting position wherein the first and second transfer wheels 4 pick up a pin 5 of bin tray 9. Also, during the upward movement of the picked up pin by the transfer wheel 4, the racks 8 interlocking with the transfer wheels 4 slowly and successively transfer another pin 5 upwards in order to allow another pin 5 to be newly positioned in said waiting position.

In other words, while the first and second transfer wheels 4 are transferring the picked up pin tray 5 upwardly along the slot liners 2, the racks 8 each interlocking with each transfer wheel 4 slowly and successively transfer another pin 5 seated on the base pin 10 upwardly, as shown in FIG. 2A. On the contrary, while the first and second transfer wheels 4 are transferring the picked up pin tray 5 downwardly along the slot liners 2 to the lower parts of respective inclined middle portions of the slot liners 2, the racks 8 each interlocking with each transfer wheel 4 slowly and successively transfer other pin, positioned in said lower part of the inclined middle portion of the slot liner 2, linearly and downwardly in order to secure a space capable of receiving a new pin.

In the drawings, the reference numeral 12 designates a microswitch adapted for detecting the rotational position of the second transfer wheel 4.

Turning next to FIGS. 3 and 4 which are a perspective view of a side plate 1 provided with a transfer wheel 4 in accordance with the present invention and a broken perspective view of an embodiment of a transfer wheel in accordance with the present invention, the transfer wheel 4 of the tray transferring device is provided with a generally circular transfer wheel body 40 provided with a spur gear 41 formed on the whole circumferential surface thereof and three slots 44*a*, 44*b* and 44*c* each arranged at every 120° angle centering around a center rotating shaft hole 42 and extending radially inward from a circumference of said transfer wheel body 40, each said slot 44*a*, 44*b*, 44*c* provided with guide portion for guiding one pin of said pins. The transfer wheel body 40 is also provided with three pairs of insert wheels 46 and 47 each pair located and spaced apart between two slots 44*a*, 44*b* and 44*c*. The insert wheels 46, 47 each is inserted onto a insert wheel supporting shaft 43 formed as protruding on the surface of the body 40 and biased upwardly by a spring 45 interposed between said insert wheel 46, 47 and the wheel body 40.

Additionally, the insert wheels 46 and 47 comprise two wheels, a first wheel 46 simply passing a first pair of circumferential wheel driving projections 32*b* and 32*c* provided on a wheel contacting surface 30 of said side plate 10 so that it can maintain its biased position by the spring 45 but retracted toward the wheel body 40 against the power of the spring 45 during contacting with a second pair of circumferential wheel driving projections 32*a* and 32*d*, and a second wheel 47 simply passing the second pair of circumferencial wheel driving projections 32*a* and 32*d* so that it can maintain its biased position by the spring 45 but retracted toward the wheel body 40 against the power of the spring 45 during contacting with the first pair of circumferencial wheel driving projections 32*b* and 32*c*. The insert wheels 46 and 47 each has two passages different from each other and alternately contacting with the pin 5 in order to guide the pin 5 into the slot 44 in spring biased or retracted position of each insert wheel 46, 47.

In the drawings, the reference numerals 31 and 42 designate a transfer wheel supporting shaft and a center opening of the transfer wheel body 40 for receiving the rotational shaft, respectively.

Turning next to FIGS. 5A and 5B which are side views of two embodiments of transfer wheels in accordance with the present invention, said embodiments of transfer wheels having outer shapes different from each other and comprising the first transfer wheel mounted at the motor driving side and shown in FIG. 5A, and the second transfer wheel mounted at the rotation detecting side of the tray transferring device and shown in FIG. 5B.

As shown in the drawings, the first transfer wheel 4 is provided with the two types of insert wheels 46 and 47 each provided with an elliptic outer surface 46*a*', 47*a*' and an elliptic inner surface 46*a*'', 47*a*'' for guiding the pin 5 of the bin tray 9. The first transfer wheel 4 also has a bevel gear shaft 48 integrally formed with the rear surface thereof and adapted for transmitting the rotation power from a motor (not shown) thereto, and a spur gear 41 formed around the circumferencial surface thereof for transmitting the rotation power to the mechanism for transferring the bin tray.

On the other hand, the second transfer wheel 4 is also provided with the two types of insert wheels 46 and 47 each provided with the elliptic outer surface 46*a*', 47*a*' and the elliptic inner surface 46*a*'', 47*a*'' inscribed with the slot for guiding the pin 5 of the bin tray 9. The second transfer wheel 4 also has a spur gear 41 formed around the circumferencial surface thereof and adapted for being transmitted the rotation power from the first transfer wheel 4, and a rotation detecting shaft 51 formed around the circumferencial surface thereof and provided with a cylindrical rotation detecting shaft 51 formed on the center of the rear surface of the wheel body 40 and including detecting slots 51*a* which each is formed on the outer side surface and extending circumferencially.

The first and second transfer wheels 4 mounted at the motor driving side and at the rotation detecting side of the tray transferring device, respectively, each includes outer passage 46*a*', 47*a*' at the insert wheel 46, 47, said outer passage 46*a*', 47*a*' provided in order to contact with the pin 5 by means of the interaction of the insert wheels 46 and 47 and the circumferencial wheel driving projections, thereby guiding the pin 5 into the slots of the transfer wheel 4. The outer passage 46*a*', 47*a*' has a normally formed elliptic portion having a height difference between the start point and the last point thereof, said height being relatively larger than the diameter of the pin. Therefore, the transfer wheel 4 can provide a smooth movement for the pin during the linear movement thereof by the rack.

Generally, the above-mentioned transfer wheels 46 and 47 of the two types are mounted at the opposite side plates 1 of the sorter, respectively, so that the bin tray 5 can be driven to be transferred without increasing the load instantaneously and also can be driven silently during successive transferring of the bin trays 9.

As above-mentioned, the present invention can prevent the instantaneous increase of the load from a tray transferring device during the successive transferring of the bin trays so that the total load to be loaded to the tray transferring device may be reduced, thereby causing the bin tray to be smoothly transferred. Furthermore, the present invention can provide a tray transferring device capable of reducing the noise which may be generated from the intermittent and instantaneous movement of the bin tray, and increasing the transferring speed of the bin tray.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. In a sorter for a copy machine, the sorter having opposite side plates and provided with a tray transferring device for transferring bin trays each having a pair of pins, said tray transferring device comprising;

first and second slot liners formed on opposite side plates of the sorter, respectively, and each having an inclined middle portion extending toward an ejecting section of the copy machine;

a first transfer wheel mounted at said inclined middle portion of said first slot liner and including a rounded portion having a first height difference between a start point and a last point of a guide passage adapted for contacting one pin of said pins in order to guide said pin, said first height difference being larger than a diameter of said pin;

a second transfer wheel mounted at the inclined middle portion of said second slot liner and including a rounded portion having a second height difference between a start point and a last point of a guide passage adapted for contacting the other pin of said pins in order to guide said pin, said second height difference being larger than a diameter of said pin;

power transferring means connected between said first and second transfer wheels and adapted for providing the same rotation rate therefor;

rack movement controlling means mounted at said opposite side plates and adapted for controlling a driving rate of racks by using a rotation power of said first and second transfer wheels;

rack driving means each connected to said rack movement controlling means;

a pair of racks each engaging said rack driving means and having a lower portion fixedly connected to said pin of a lowest positioned bin tray, and supporting means fixedly connected to said opposite said plates and adapted for supporting said bin trays.

2. In a sorter for a copy machine, the sorter having opposite side plates and provided with a tray transferring device for transferring bin trays each having a pair of pins, said tray transferring device comprising:

first and second slot liners formed on said opposite side plates of the sorter, respectively, and each having an inclined middle portion extending toward an ejecting section of the copy machine;

third and fourth slot liners downwardly formed on said opposite side plates of the sorter;

a first transfer wheel mounted at the inclined middle portion of said first slot liner and including a rounded portion having a first height difference between a start point and a last point of a guide passage adapted for contacting one pin of said pins in order to guide said pin, said first height difference being larger than a diameter of said pin;

a second transfer wheel mounted at the inclined middle portion of said second slot liner and including a rounded portion having a second height difference between a start point and a last point of a guide passage adapted for contacting the other pin of said pins in order to guide said pin, said second height difference being larger than a diameter of said pin;

power transferring means connected between said first and second transfer wheels and adapted for providing the same rotation rate therefor;

rack movement controlling means mounted at said opposite side plates and adapted for controlling a driving rate of racks by using a rotation power of said first and second transfer wheels;

rack driving means each connected to said rack movement controlling means;

a base pin extending between respective lowest portions of said first and second slot liners;

a pair of racks each engaging with said rack driving means and having a lower portion fixedly connected to each end of said base pin; and tray supporting means fixedly connected to said opposite side plates, respectively, and forming a supporter movable upward and downward along said third and fourth slot liners in order to provide the same upward and downward movements for inner and outer portions of said bin trays at the same time during movement of the bin trays.

3. A tray transferring device in accordance with claim 2, wherein said first transfer wheel comprises:

a transfer wheel body provided with three slots each arranged at every 120° angle centering around a center rotating shaft hole, extending radially inward from a circumference of said transfer wheel body and having a guide portion for guiding said one pin;

three pairs of insert wheels, each said pair of insert wheels located and nearly spaced apart between two of said slots in order to alternately pick up and push a pin moving along said first slot liner;

insert wheel mounting means for mounting said insert wheel onto said transfer wheel body;

driving means for providing a rotation power for said transfer wheel body; and a spur gear formed around a circumferential surface of said transfer wheel body and adapted for transmitting the rotation power to another mechanism.

4. A tray transferring device in accordance with claim 2, wherein said second transfer wheel comprises:

a transfer wheel body provided with three slots each arranged at every 120° angle centering around a center rotating shaft hole, extending radially inward from a circumference of said transfer wheel body and having a guide portion for guiding said one pin;

three pairs of insert wheels, each of said pairs of insert wheels located and nearly spaced apart between two of said slots in order to alternately pick up and push a pin moving along said second slot liner;

insert wheel mounting means for mounting each of said insert wheels onto said transfer wheel body;

driving means for providing a rotation power for said transfer wheel body; and rotational position detecting means provided on the center of a rear surface of said transfer wheel body and including rotational position detecting slots.

5. A tray transferring device in accordance with any one of claims 3 and 4, wherein said power transferring means comprises:

a first shaft driving gear engaging with said spur gear of said first transfer wheel;

a second shaft driving gear positioned in order to be opposite to said first shaft driving gear and engaging with said spur gear of said second transfer wheel; and a driving shaft extending between said first and second shaft driving gears in order to connect said first and second shaft driving gears with each other.

6. A tray transferring device in accordance with claim 5, wherein said rack movement controlling means comprises:

first middle gears including an idle gear engaging with said spur gear of said first transfer wheel and a middle reduction gear integrally formed with said idle gear at a center of said idle gear; and second middle gears including an idle gear engaging with said spur gear of said second transfer wheel and a middle reduction gear integrally formed with said idle gear at a center of said idle gear.

7. A tray transferring device in accordance with claim 5, wherein said rack driving means comprises:

first rack driving gears including a rack driving reduction gear engaging with said middle reduction gear of said first middle gears and a pinion gear provided at a center shaft of said rack driving reduction gear; and second rack driving gears including a rack driving reduction gear engaging with said middle reduction gear of said second middle gears and a pinion gear provided at a center shaft of said rack driving reduction gear.

8. A tray transferring device in accordance with any one of claims 3 and 4, wherein said each of said insert wheels comprises:

an elliptic outer passage for contacting with said pin in order to guide said pin and an elliptic inner passage inscribed with said slot for guiding said pin, said inner and outer passages providing an outer elliptic surface portion between said slots for each said transfer wheel.

* * * * *